US005544594A

United States Patent [19]

Schairbaum

[11] Patent Number: 5,544,594

[45] Date of Patent: Aug. 13, 1996

[54] ADJUSTABLE MONITOR SUPPORT ASSEMBLY

[75] Inventor: Edward C. Schairbaum, Ft. Worth, Tex.

[73] Assignee: Nova Manufacturing & Assembly, Inc., Effingham, Ill.

[21] Appl. No.: 454,677

[22] Filed: May 31, 1995

[51] Int. Cl.[6] ..... A47B 35/00

[52] U.S. Cl. ..... 108/50; 108/8; 248/923; 248/393; 312/194

[58] Field of Search ..... 108/50, 28, 1, 108/8; 312/194, 208.3, 208.1, 203; 140/923, 920, 922, 393, 398

[56] References Cited

U.S. PATENT DOCUMENTS

| | | | |
|---|---|---|---|
| 1,605,550 | 11/1926 | Krugly et al. | 108/8 X |
| 4,515,086 | 5/1985 | Kwiecinski et al. | 248/920 X |
| 4,590,866 | 5/1986 | Schairbaum . | |
| 4,755,009 | 7/1988 | Price et al. . | |
| 4,947,763 | 8/1990 | Piorek | 108/8 |
| 5,071,204 | 12/1991 | Price et al. . | |
| 5,087,010 | 2/1992 | Walters . | |
| 5,125,727 | 6/1992 | Lechman et al. . | |
| 5,199,773 | 4/1993 | Price, Jr. et al. | 312/194 X |
| 5,368,377 | 11/1994 | Baines | 312/194 X |
| 5,410,972 | 5/1995 | Schairbaum | 248/923 X |

FOREIGN PATENT DOCUMENTS

| | | | |
|---|---|---|---|
| 1106895 | 8/1981 | Canada . | |
| 577278 | 5/1933 | Germany | 312/194 |

*Primary Examiner*—José V. Chen
*Attorney, Agent, or Firm*—Olson & Hierl, Ltd.

[57] ABSTRACT

An adjustable monitor support assembly for a monitor is positioned under a transparent portion in the top surface member of a desk-like structure. The support assembly utilizes a shelf member that is supported by laterally outwardly extending associated stub shafts. A pair of rails is provided and each one thereof is located along a different lateral side of the shelf member. The stub shafts slidably engage the rails so that the shelf member is movable relative to the rails. Retaining members for holding the shelf member at a desired location along the rails are provided. Since the rails are parabolically curved, the monitor is movable with the front face being generally perpendicular to the eye levels of various seated users.

15 Claims, 2 Drawing Sheets

ADJUSTABLE MONITOR SUPPORT ASSEMBLY

FIELD OF THE INVENTION

This invention relates to underdesk monitor support assemblies for desk structures and the like that have a transparent top portion through which a supported monitor can be viewed.

BACKGROUND OF THE INVENTION

When a desk or similar structure is provided with a top member that incorporates a transparent surface portion, it becomes possible to position a cathode ray tube (CRT) or monitor under the desk top surface for viewability through the transparent surface portion. Such arrangements are shown, for example, in Schairbaum U.S. Pat. No. 4,590,866 and Lechman et al. U.S. Pat. No. 5,125,727.

Such a monitor is in operative and functional association with a computer central processing unit (CPU) which can be in the desk structure or elsewhere as desired and also usually with a keyboard which is supported by the desk structure.

Because of the multiplicity of different desk structures and the like which can be equipped with a transparent top surface portion, there is a need in this new and developing art for a monitor support assembly that is adaptable for use in many different desk structures. The monitor support assembly should also be adjustable so as to regulate the tilt angle and the height of a monitor supported thereby relative to the overlying transparent surface portion of a desk structure so as to meet the needs of the individual use situation and the desires of the individual user. In addition, a monitor support assembly should be safe and effective for use by a user of such equipment.

The present invention provides such an improved monitor support assembly.

SUMMARY OF THE INVENTION

The present invention provides a new and improved adjustable assembly for supporting a monitor means or the like under a desk top surface that has a transparent portion.

The present invention also provides improved combinations of a desk or like structure with the adjustable monitor support assembly.

In an embodiment of the adjustable monitor support assembly of this invention, a shelf member is utilized which can have various structures but which preferably has a bottom support member and an upstanding back support member. It is also preferred that the bottom support member and the back support member are each generally flat, extend generally perpendicularly to each other, are integral with one another along an adjoining edge portion, and have generally parallel opposed lateral sides which are generally perpendicular to the back support and bottom support members. Preferably, a side wall or side rail is provided along and between the opposed lateral sides of the bottom and back members. This shelf member is adapted to support a monitor (or CRT) that is rested thereupon.

The shelf member is supported relative to a desk (or work station) or like structure by means of a pair of side rails which have a parabolic-type longitudinal curvature. Each one of these rails is located along a different respective lateral side of the shelf member. Each of the side rails can be variously defined, such as by a depression, slot, track, ridge, or the like in a supporting or structural member which by present preference is an elongated slide plate member.

Each such slide plate member of the pair is preferably vertically oriented and in a spaced opposed relationship relative to the other. Each plate member is individually and independently supported by screws or the like from an adjacent kneehole side wall or the like in a desk-like structure although if desired any convenient support means, so that the slide plate members and the whole monitor support assembly can be used with many different desks or like structures.

Each member of the longitudinally curved rail pairs is in laterally spaced, parallel, mirror-imaged-type relationship relative to the other thereof.

The shelf member is disposed between the members of the rail pair. Shaft means that is associated with the shelf member and laterally outwardly projects from the opposed lateral sides thereof slidably supports the shelf member upon the rails.

By moving the shelf member along the rails, the shaft member spatial position and tilt angle are adjustable. By adjusting and preselecting the exact curvature of the rail pathways, the front face of a monitor that is supported by the shelf member is maintained in a generally perpendicular position relative to various locations within and along a predetermined height range. Thus, the position and tilt angle of a monitor supported under the transparent top portion of a work surface can be adjusted for perpendicular viewing by a user seated adjacent the desk structure. The height range for adjustability of the monitor orientation is preferably chosen to include the range of all eye level heights (above a desk-like top surface) of a typical seated user within a given user class.

Once a desired position for such a supported monitor is achieved, the shelf member is fixed or stabilized relative to the associated rail members by adjustable holding or clamping means.

The shelf member, the rail structures and the shaft means can each be formed of any convenient or appropriate material, such as sheet metal, interwelded heavy wire components, fiber reinforced plastic, or the like.

The monitor support assembly of the present invention can be used in a desk or work station having virtually any size of kneehole, or even in a table which does not define a kneehole. It can also be retrofitted into an existing desk structure.

The support assembly of this invention is simple, easy to operate, and has virtually no required periodic maintenance or the like. It employs a minimum of parts and component subassemblies.

The present adjustable monitor assembly is believed to offer a substantial advance in the art of underdesk monitor supports. The assembly overcomes various problems and limitations associated with various prior art underdesk monitor mounting assemblies.

Other and further objects, aims, purposes, features, advantages, and the like will be apparent to those skilled in the art from the present specification taken with the accompanying drawings.

BRIEF DESCRIPTION OF THE DRAWINGS

In the accompanying drawings, which comprise a portion of this disclosure.

DETAILED DESCRIPTION

Figure 1:
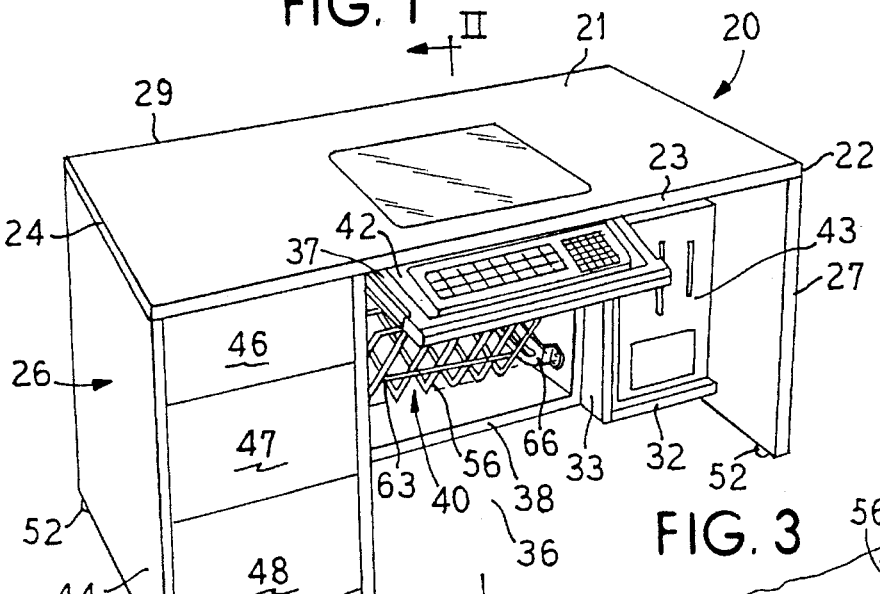
FIG. 1 is a perspective view of one embodiment of a monitor support assembly of the present invention mounted under one type of desk structure.
Figure 3:
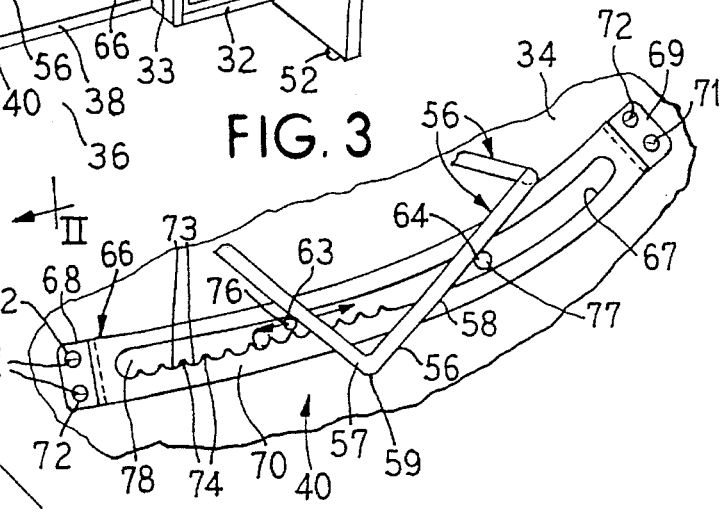
FIG. 3 is a fragmentary enlarged side elevational view taken generally along the line III—III of FIG. 2 showing details of one side plate and its incorporated rail structure.

Referring to the drawings, there is seen in FIGS. 1 through 4 an illustrative embodiment of a desk-like structure 20 that is functionally associated with a monitor support assembly 40 of the present invention. The desk 20 illustratively shown in the drawing has a generally rectangular flat top surface member 21 and desk 20 is suitable for positioning adjacent a wall or in a room interior or elsewhere as desired. However, any shape or size of desk can be used with assembly 40.

The top flat surface member 21 of desk 20 is supported by a peripheral side wall 27 along and under its right side edge (relative to a user seated along a mid-region of the front elongated side 23, the user not being shown in the Figures). Undersurface portions of top flat surface 21 adjacent the left side edge 24 thereof are supported by a pedestal structure 26. The side wall member 27 and the pedestal structure 26 adjoin a back wall member 28 (see FIG. 2, for example) that extends under and across the back edge 29 of top flat surface member 21. A slot 31 is provided which extends between back wall 28 and top surface member 21 for air circulation purposes.

Secured to, and inwardly extending from, side wall 22 is a shelf member 31 which is secured along its interior lateral side edge to a supporting panel 32. The top edge of panel 32 is secured to the underside of the flat top surface member 21.

Secured to, and inwardly extending from, side wall 22 in an upwardly spaced, parallel relationship to the bottom edge of the side wall 27, is a shelf member 32 which is secured along its interior lateral side edge to a vertical supporting panel 33. The top edge of panel 33 is secured to the underside of the flat top surface member 21 and the back edge of panel 33 is secured to the inside of back wall member 28.

Figure 2:
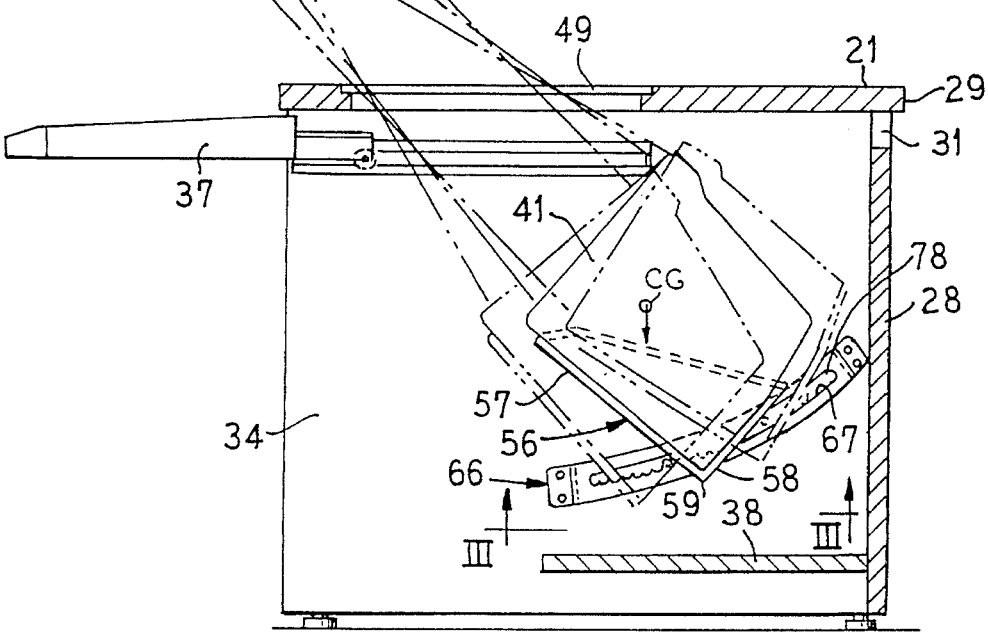
FIG. 2 is a vertical, transverse sectional view taken along the line II—II of FIG. 1 showing the monitor support assembly of FIG. 1 with a monitor supported thereby in various positions.
Figure 4:
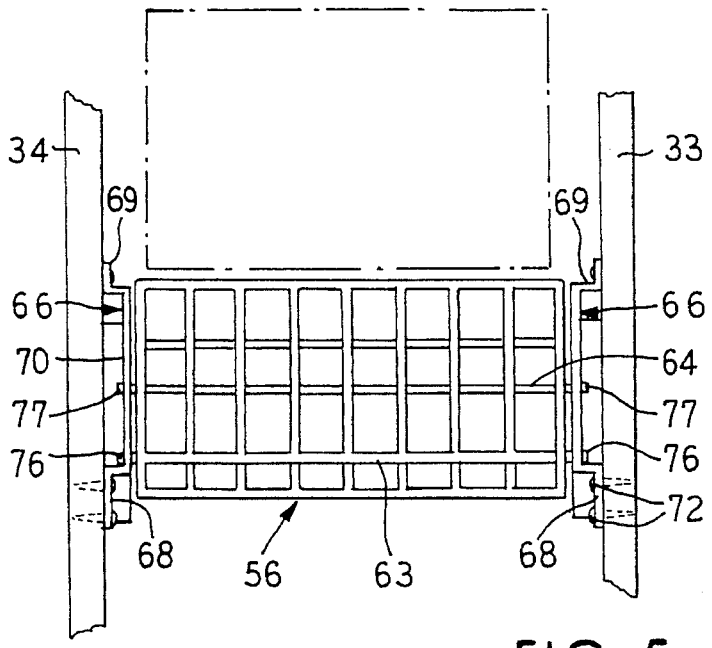
FIG. 4 is a fragmentary front elevational view showing the monitor support assembly and adjacent portions of the desk structure of FIG. 1 and showing the front face of a monitor supported by the monitor support assembly in phantom.

Between the panel 32 and the inside wall 33 of the pedestal structure 26, a kneehole 34 is thus defined. Under the surface member 21 across the kneehole 36 is slidably mounted a transversely short keyboard holding platform 37 that is transversely and horizontally slidable relative to the front edge of top surface member 21 from a closed position to a fully extended position such as shown in FIGS. 1 and 2. While any convenient structure can be used for platform 37 and its slidable mounting means, the structure shown in copending U.S. patent application Ser. No. 774,416 filed Oct. 10, 1991 is now preferred (the disclosure of which is incorporated herein by reference).

Desk 20 is provided with a recessed rigidifying and structure reinforcing shelf member 38 that extends between, and is secured at its opposite ends to, respectively, panel 33 and wall 34, and also at its rear end to the inside of back wall 28. In the pedestal structure 26, and located between and suspended by the inside wall 34 and the outside wall 44 thereof, a plurality of conventional storage drawers 46, 47 and 48 or the like are conveniently provided. Between the lower edge portions of walls 34 and 40, a rigidifying horizontal panel member 51 is secured. Opposite corners of desk 20 are supported by conventional preferably adjustable feet 52 (four) relative to a floor 53.

A central processing unit (CPU) 43 can be housed, if desired, under surface member 21 on the shelf 32.

A monitor 41 (see FIG. 2) is positioned at a location in an upper rear portion of the kneehole 36 from where its screen is visible through a transparent portion, such as is provided by a rectangular or square piece 49 that is comprised of glass, clear plastic, or the like, and that is inset centrally in, and is supported by, surface member 21. The monitor 41 is supported by the monitor support assembly 40. The monitor 41 and a keyboard 42 that is shown resting on holding platform 37 are each functionally interconnected by electrical cables (not shown) or the like with the CPU 43, thereby providing a complete wordprocessing work station, or the like, if desired, within the desk structure 20. Alternatively, a CPU can be located remotely (not shown) relative to the desk 20, and the monitor 41 and the keyboard 42 can be connected therewith by electrical cable means (not shown) as those skilled in the art will readily appreciate.

Support assembly embodiment 40 incorporates a shelf member 56 having a flattened rectangular bottom member 57 and also a flattened rectangular back member 58 that preferably integrally upstands or extends preferably perpendicularly from an adjoining rear edge 59 located between bottom member 57 and back member 58.

Shelf member 56 can be comprised of various materials, but, in support assembly 40, shelf member 56 embodiment is shown as being comprised of formed heavy wire members that are interwelded together at all regions of crossover or abutment. Any convenient wire fabrication procedure or wire arrangement can be used.

For example, and as shown in FIGS. 1–4, the shelf member 56 includes a rectangularly extending perimeter wire 61 which continuously extends about the outer three edges of each of the back member 58 and the bottom member 57 with a 90° turn being provided at the edge 59. Transversely extending from the front edge of the bottom member 57 to the back edge of the back member 58 in laterally spaced parallel relationship both to one another, and also to the lateral sides of the perimeter wire 61, are a plurality of support wires 62 which are each straight except for a 90° bend at edge 59.

Respective opposite ends of each support wire 62 are welded to contacting portions of each of the front edge portion and the back edge portion of perimeter wire 61. A longitudinally extending straight reinforcing heavy bottom rib wire 63 extends across the outside of bottom member 57 in spaced, parallel relationship to edge 59, and is welded both to the respective support wires 62 at crossover locations and also to lateral sides of the perimeter wire 61 adjacent to wire 63 opposed ends. Similarly, a longitudinally extending straight reinforcing heavy back rib wire 64 extends across the outside of back member 58 in spaced, parallel relationship to edge 59, and is welded both to the respective support wires 62 at crossover locations and also to lateral sides of the perimeter wire 61 adjacent to wire 64 opposed ends. The respective opposed ends of each of wires 63 and 64 extend laterally outwardly beyond the adjacent perimeter wire 61, thereby to provide two pairs of laterally opposed stub shafts 76 and 77 that are adapted to support the shelf member 56 in the manner explained below.

The shelf member 56 is also provided with a pair of side support and retaining wire members 61, each one being a relatively heavy (i.e., thick or stiff) wire extending from a different open corner of the back member 58 to the open corner of the bottom member 57 on the same side of the shelf member 56. Approaching the corners of the bottom member 57, the side members 61 are each preferably provided with an upstanding convex curvature (as shown) so as to effectively provide a retaining shoulder on each lateral side of the bottom member 57. The opposite ends of each side wire member 61 are welded respectively to the adjacent respective corners of the bottom member 57 and the back member 58.

Thus, a monitor 41 can be set upon shelf member 56 with bottom portions thereof resting upon bottom member 57 and with rear end portions thereof resting upon back member 58. The monitor 41 is retained on the bottom members 57 and on the back member 58, and lateral sliding movements away therefrom are prevented by the side members 61.

In place of the single side wire members 61, one can employ an interwelded wire arrangement, if desired, for each of a pair of side wall structures, each such structure incorporating a plurality of separate interwelded wire members, for example (not shown). In general, it is preferred that a side wall structure be integrally associated with the bottom member 57 and with the back member 58. Preferably, the side wall on each lateral side of shelf member 56 is tapered or diagonally extends along its upper edge from back member 58 to bottom member 57.

Support assembly embodiment 40 also incorporates a pair of elongated curving slide plate members or rail carrier strips 66, each one being a mirror image of the other. Each slide plate member 66 can be formed of heavy gauge formed sheet metal or the like. Each slide plate member 66 has longitudinally defined therein a rail 67. Each rail 67 comprises the lower edge of an elongated curving slot 78. The slot 78 width is chosen so as to be at least equal to the diameter of the stub shafts 76 and 77 of the end portions rib wires 63 and 64.

The opposite terminal ends 68 and 69 of each plate member 66 are offset in a common direction on one side of the plate member 66 so that, when each plate member 66 is laid upon a flat surface, an elongated curved central region 70 between these offset opposite ends 68 and 69 upstands in adjacent, spaced, parallel relationship to such surface with the rail 67 being located along the mid-region in this upstanding elongated curved region 70. Each of the offset ends 68 and 69 of each plate member 66 is provided with apertures 71 defined therein so that fastening means, such as screws 72 or the like, can be extended therethrough for mounting each of the slide plate members 66 in spaced, aligned, mirror-imaged relationship relative to one another so that each rail 67 is on a different lateral side of the shelf member 56, as desired. Thus, in the exemplary desk 20, one slide plate member 66 is mounted against panel 33, and the other slide plate member 66 is mounted against wall member 34 so as to be on opposing sides of the kneehole 36. Preferably, the members 66 are mounted at about knee level of the user.

Each of the rails 67 exhibits a curved pathway along the length thereof. The curvature is generally parabolically configured but can be otherwise if desired to obtain the desired range of monitor tilting capacity. When the slide plate members 66 are mounted as described above, the pathway of each rail 67 is oriented in spaced parallel relationship to the other.

In monitor support assembly 40, the gravitationally lower side edge of each rail 67 is provided with undulations or a plurality of successively alternating depressions 73 and elevations 74 along the length thereof in the manner of a relatively large sawtooth or serrated configuration. The curvature of each depression 73 preferably is such as to accommodate the diameter of each of the stub shafts 76 and 77 provided at opposing ends of the respective rib wires 63 and 64.

Thus, when a stub shaft 76 and 77 rests in a depression 73, a circumferential stub shaft portion of shaft 76 or 77 up to about one half of the shaft circumference is adapted to be engaged with that depression 73. The relationship between depressions and stub shafts is preferably such that displacement of stub shafts is resistant to casual bumps, such as by a knee against a support shelf member.

When a shelf member 56 is suspended between a pair of slide plate members 66 that are themselves mounted under a desk, such as the desk 20 in the manner described above, each of the two stub shafts of 76 and 77 of each of the rib wires 63 and 64 that are located on a common lateral side of the shelf member 56 extend into an adjacent slot 78 for support by rail 67. The outer ends of stub shafts 76 and 77 are spaced from adjacent respective surface portions of the desk (panel 33 and wall 34). Also, these stub shafts 76 and 77 are slidably movable along their respective associated rails 67 when the shelf member 56 is elevated slightly to an extent such that the stub shafts 76 and 77 are disengaged from the adjacent depressions 68.

When a monitor 41 is resting upon shelf member 56, the arrangement existing between the shelf member 56, the rails or tracks 67 and the stub shafts of rib wires 63 and 64 is such that the center of gravity (as indicated by the initials "CG" in FIG. 2) for the monitor-loaded shelf member 56 is located so as to exert a downwardly directed vector component that is sufficient to retain the individual respective stub shafts 76 and 77 in engagement with any chosen one of the depressions 68 that is connected therewith along the respective rail 67 pathways.

The relationship between the components of monitor support assembly 40 is such that, when the shelf member 56 is thus slidably moved and positioned along the rails 67, the spatial position and tilt angle of the shelf member 56 are adjustable. Thus, the spatial position of shelf member 56 and the tilt angle of the front face of the monitor 41 resting on shelf member 56 are adjustable. By adjusting and selecting the curvature of the rail 67 pathways, the front face of monitor 41 is maintainable during slidable movement and positioning in a generally perpendicular position relative to desired locations along and within a predetermined height range 79 that extends vertically above the front side edge 23 of desk 20. This predetermined height range 79 is preferably selected to correspond with the expected range of eye heights above the surface 21 for users seated in front of the desk 20. Thus, the position and tilt angle of the supported monitor 41 are adjustable, yet a given user can view the front face of the monitor 41 through the transparent portion 49.

Preferably, the height range 79 is selected to generally include almost all viewers (users) within a predetermined class. Thus, the monitor 41 on shelf member 56 is movable along tracks 67 so that the front face thereof is perpendicularly viewable by any user in this class. Movement and adjustment are achieved in a simple and slidable manner. Once moved, the monitor 41 is held in a stationary position by the retaining action of the depressions 68 upon their respective stub shafts 76 and 77 that are engaged therewith.

Figure 5:
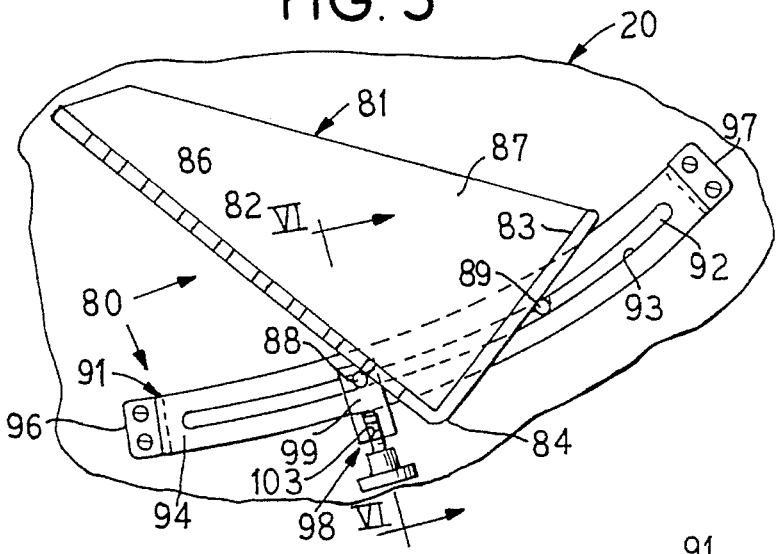
FIG. 5 is a view similar to FIG. 3 but showing an alternative embodiment of a monitor support assembly of this invention.
Figure 6:
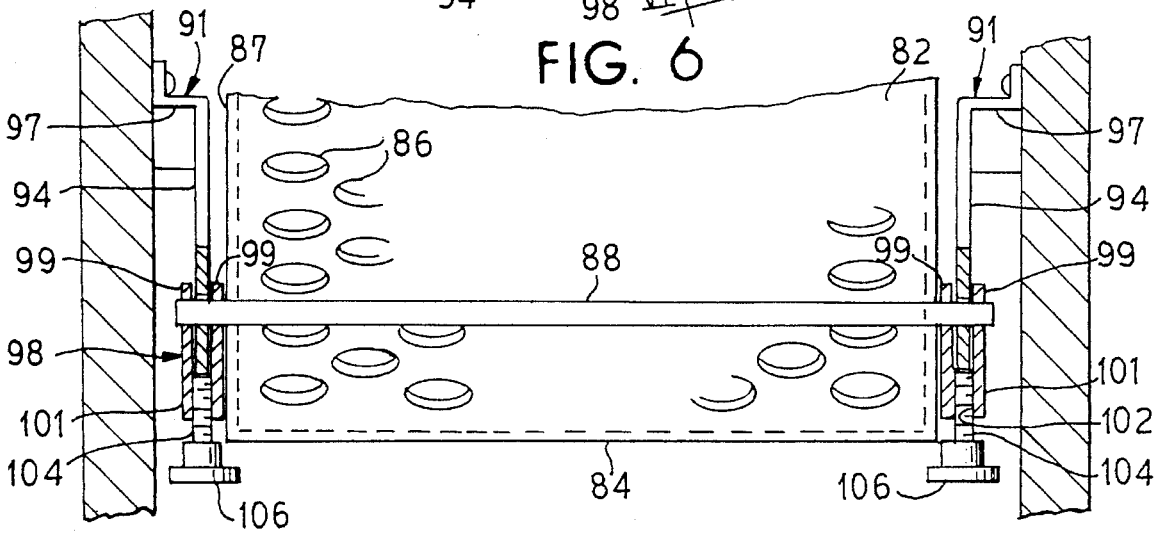
FIG. 6 is a fragmentary laterally taken vertical sectional view through a forward portion of the monitor support assembly of FIG. 5 in combination with adjacent portions of an associated desk structure, some parts thereof being broken away and some parts thereof being shown in section.

In FIGS. 5 and 6, there is seen another illustrative embodiment of a monitor support assembly 80 which is shown functionally associated with the exemplary desk structure 20. Components of desk structure 20 shown in FIGS. 5 and 6 are similarly numbered in FIGS. 1–4 for identification purposes.

Support assembly embodiment 80 incorporates a shelf member 81 having a rectangular flattened bottom member 82 and a rectangular flattened back member 83 that preferably upstands perpendicularly from the adjoining rear edge 84 between bottom member 82 and back member 83. Like shelf member 56, shelf member 81 can be comprised of various materials, but here the bottom member 82 and the back member 83 are shown as being comprised of sheet metal that has been perforated with a plurality of circular apertures 86 for air cooling purposes and that has been bent to form rear edge 84. A side wall 87 extends along each lateral side of shelf member 81 and each is shown as being comprised of sheet metal which is fastened by spot welding (not shown) or the like at edge portions thereof to respective adjacent edge portions of bottom member 82 and back member 83. If desired, the side walls (paired) 87 can be perforated with vent apertures (not shown). When a monitor (not shown) is centrally resting upon shelf member 81, there is usually an air gap along each lateral side which aids in achieving sufficient air movement for side air cooling of the monitor.

Shelf member 81, like shelf member 56, is provided with a pair of heavy rib wires 88 and 89 which each extend laterally across outside surface portions of, respectively, the bottom member 82 and the back member 83. Each rib wire is fastened to its adjacent shelf member positions by any convenient means, such as welding (not shown) or the like. The respective opposed ends of each wire 88 and 89 extend laterally and outwardly beyond the lateral sides of shelf member 81, thereby to provide stub shafts (one pair for each of wires 88 and 89) with which the shelf member 81 is spatially supported (as described below).

Support assembly embodiment 80 also utilizes a pair of slide plates 91. These slide plates 91 are similar in structure and function to the slide plates 66, except that each of the elongated curved slots 92 therein has a smooth, continuously extending track surface 93 on the lower or rail edge of each slot 92. As in the slide plates 66, the slots 92 are located in the elongated curved mid-region 94 thereof (which terminates in the offset opposite end regions 96 and 97) and the slot width is at least equal to the stub shaft diameters.

The elongated curved mid-region 94 of each slide plate 91 is associated with a U-configured clamp assembly 98 (paired). Each clamp assembly 98 has a pair of spaced, parallel legs 99 that are receivable over opposite sides of mid-region 94 and are slidably movable along mid-region 94. The legs 99 are each integrally interconnected with a common base 101 that is edge located relative to the mid-region 94.

Adjacent their respective open ends, each of the legs 99 is provided with a transversely extending aperture 102 that is aligned with the other thereof and also with slot 92. Thus, a stub shaft on either end of each of the rib wires 88 and 89 in the assembled configuration of assembly 80 extends through the apertures 102 and also the slot 92. Thus, the clamp assembly 98 is retainable in association with the plate member 91. The base 101 is provided with a longitudinal (relative to clamp 98) central aperture 103 through which a screw member 104 with a relatively large hand-graspable head 106 is threadably received. The forward end of screw member 104 is adapted to abut against an edge portion of plate 91 when the screw member 104 is manually turned and advanced and apertures 102 become engaged against adjacent portions of the stub shafts. Thus, the clamp assemblies 98 provide retaining means for holding the shelf member 81 in a desired relationship with respect to each of the slide plates 91.

As can be seen from the foregoing description, a shelf member can be supported from the rails by a minimum of three stub shaft means with the maximum number being as desired; however, four spaced parallel stub shafts, as illustrated herein, are preferred.

In effect, with a monitor support assembly of this invention, the orientation of the front face of a monitor can be regarded as being self-adjusted through a predetermined angle (relative to vertical) as the monitor support shelf is slidably moved along the rails by the stub shafts. The rail curvature can be adjusted to achieve whatever specific height relationship is desired; possible variables include user torso or body height range, user vantage points, equipment proportions or sizes (including chair seat height above floor level), and the like.

Various other and further embodiments, applications, structures, and the like will be apparent to those skilled in the art from the teachings provided herein and no undue limitations are to be drawn therefrom.

What is claimed is:

1. An adjustable monitor support assembly for mounting within a desk-like structure that has a top surface member with a transparent portion and through which transparent portion a monitor that is supported by said monitor support assembly is viewable, said monitor support assembly comprising in combination:

(a) a shelf member for supporting said monitor, said shelf member having opposed lateral sides;

(b) at least three stub shaft means each of which is associated with said shelf member and including association means therefor, each said stub shaft means being laterally outwardly extending from said lateral sides, so that said shelf member is supportable by said stub shaft means;

(c) a pair of rail means, each one of said rail means being adjacently locatable along a different one of said lateral sides, and including means for mounting said rail means to said desk-like structure, each one of said rail means having a parabolic-type curvature and being orientable so that one thereof is substantially a mirror image of the other thereof;

(d) said stub shaft means being engagable with said rail means so that said shelf member is supported by, and is slidably movable relative to, said rail means;

(e) retaining means for holding said shelf member at desired locations along said rail means; and (f) the interrelationship between said shelf member, said stub shaft means, said rail means and said retaining means being such that said monitor when supported by said shelf member is adjustable to a variety of positions and angles with the front face of said monitor being maintained in a generally perpendicular position relative to various locations within a predetermined height range extending generally vertically above said desk-like structure when said monitor support assembly is mounted within said desk-like structure.

2. The adjustable monitor support assembly of claim 1 wherein two pairs of said stub shaft means are so associated, each member of each said pair of stub shaft means extends laterally and outwardly from a different one of said lateral sides and also is in spaced generally coaxial alignment relative to the other member thereof, and each one of said pairs of stub shaft means is transversely spaced on said shelf member relative to the other one of said pairs of stub shaft means.

3. The adjustable monitor support assembly of claim 1 wherein each one of said rail means is defined by the lower edge portions of an elongated, curved slot that exists in a plate member, and the transverse width of said slot is at least equal to the transverse thickness of said stub shaft means.

4. The adjustable monitor support assembly of claim 3 wherein each said plate member has an elongated strip-like configuration, opposite ends of said configuration are offset in a common direction on one side of said plate member so that, when said plate member is laid upon a flat surface, an elongated region exists between said offset opposite ends, and so that said elongated curved region upstands in spaced, parallel relationship to said flat surface with said rail means as defined therein being located in said elongated curved region.

5. The adjustable monitor support assembly of claim 4 wherein said elongated curved region is further associated with a U-configured clamp assembly having legs that are slidably movable therealong and an interconnective base that is edge located relative to said plate member during said sliding movements, said legs being provided with aligned apertures which overlie opposed sides of said slot and through which a said stub shaft is extend so as to retain said clamp assembly in association with said plate member, and said base has screw means extending therethrough whose forward end portion abuts against an edge portion of said plate member when said screw means is advanced, thereby to provide said retaining means.

6. The adjustable monitor support assembly of claim 3 wherein each of said offset opposite ends is provided with aperture means and said means for mounting comprises screw means that is extend through said aperture means.

7. The adjustable monitor support assembly of claim 3 wherein said rail means has a region therealong wherein a succession of alternately arranged depressions and elevations is defined, and wherein the curvature of each said depression is defined to accommodate and retain a circumferential portion of a said stub shaft that is rested therein, thereby to provide said retaining means.

8. The adjustable monitor support assembly of claim 1 wherein said shelf member has a flattened bottom member and a flattened back member that extends perpendicularly to said bottom member from a common adjoining rear edge region therebetween.

9. The adjustable monitor support assembly of claim 8 wherein said shelf members and said opposed lateral sides are in spaced, parallel relationship with each other.

10. The adjustable monitor support assembly of claim 8 wherein said shelf member further includes side wall means.

11. The adjustable monitor support assembly of claim 8 wherein said shelf member is comprised of wire members that are interwelded together at all mutually contacting locations.

12. The adjustable monitor support assembly of claim 11 which further includes opposed lateral sides and each said lateral side is defined by a single wire member which, at its respective opposed terminal end portions, is interwelded respectively to said bottom member and said back member.

13. The adjustable monitor support assembly of claim 8 wherein said shelf member is comprised of sheet metal and said sheet metal is provided with apertures for air cooling.

14. The adjustable monitor support assembly of claim 8 wherein a rib wire is mounted laterally across each one of said bottom member and said back member, and wherein opposed terminal end portions of each of said rim wires extends laterally outwardly from said opposed lateral sides, thereby to provide said stub shaft means.

15. The adjustable monitor support assembly of claim 1 which is mounted within, and is thus in combination with, said desk-like structure.

* * * * *